United States Patent [19]

Dröscher et al.

[11] Patent Number: 4,591,209

[45] Date of Patent: May 27, 1986

[54] PROTECTING DEVICE FOR PARTIAL-CUT CUTTING MACHINES

[75] Inventors: Bernhard Dröscher; Otto Schetina; Herwig Wrulich; Alfred Zitz, all of Zeltweg, Austria

[73] Assignee: Voest-Alpine Aktiengesellschaft, Vienna, Austria

[21] Appl. No.: 566,416

[22] Filed: Dec. 28, 1983

[30] Foreign Application Priority Data

Dec. 31, 1982 [AT] Austria ..... 4742/82

[51] Int. Cl.[4] ..... E21C 27/20

[52] U.S. Cl. ..... 299/1; 299/75

[58] Field of Search ..... 299/1, 75; 173/4, 6, 173/11

[56] References Cited

U.S. PATENT DOCUMENTS 4,470,635 9/1984 Paurat et al. ..... 299/1

FOREIGN PATENT DOCUMENTS 2842963 4/1980 Fed. Rep. of Germany ..... 299/75

612014 6/1978 U.S.S.R. ..... 299/1

*Primary Examiner*—Stephen J. Novosad

*Assistant Examiner*—Michael A. Goodwin

*Attorney, Agent, or Firm*—Cushman, Darby & Cushman

[57] ABSTRACT

For protecting partial-cut cutting machines from overload, a vibration sensor 7 is provided on the swivellable cutting arm 2 carrying rotatably supported cutting heads 6. The signals of the vibration sensor 7 are utilized in an electronic control 8 and used for controlling the pivotal drive of the cutting arm 2. The electronic control 8 has a threshold switch which is connected with an adjusting drive for varying the supply capacity of the hydraulic pump of the pivotal drive.

9 Claims, 3 Drawing Figures

PROTECTING DEVICE FOR PARTIAL-CUT CUTTING MACHINES

Figure 1:
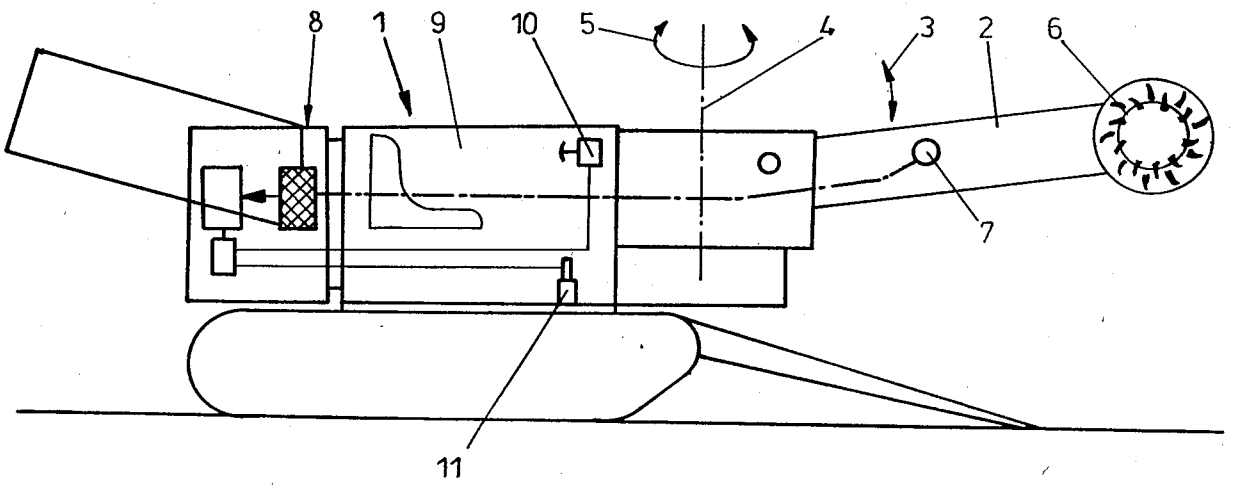

The invention refers to a device for protecting partial-cut cutting machines from overload, comprising a pivotable cutting arm carrying rotatably supported cutting heads. The cutting heads of such partial-cut cutting machines are, as a rule, designed for a certain swivelling speed of the cutting arm for obtaining a correct cutting pattern at an existing cubic strength or crushing strength of a cube. If such a cutting head is operated at a swivelling speed differing from the swivelling speed for which the arrangement of the bits on the cutting head is designed, the partial-cut cutting machine may be subject to strong vibrations, which may result in a fracture of components thereof. When excavating certain materials, it is frequently the case that partial areas of lower hardness or lower toughness or higher brittleness are worked upon, in which a higher swivelling speed of the cutting arm can be selected without the risk of inadmissible vibrations. For increasing the operating efficiency of such a partial-cut cutting machine, it is, therefore, advantageous to provide, in addition to the swivelling speed considered by the design of the arrangement of the bits on the cutting head, for a greater swivelling speed during a tool approach stroke, noting that immediately after engagement of the bits of the cutting head on the rock for which the bit arrangement has been designed, the nominal swivelling speed must be adjusted to prevent any injury to the machine.

For monitoring inadmissible operational conditions, it is already known to equip roll cutting machines with monitoring devices which monitor the temperature of the fluid circuit of the hydraulic winch, the temperature of certain bearings, the temperature of the cooling water circuit or also the pressure. A monitoring device of this type can, for example, be derived from German Offenlegungsschrift No. 29 17 054. In German Offenlegungsschrift No. 31 00 116 and in German Offenlegungsschrift No. 31 06 348 there are described sensibilized cutting tools by means of which a cutting characteristic curve for the existing rock or mineral can be sensed during cutting work of the cutting tool. Of course, such devices are relatively complex, because they must be arranged immediately within the area of the bits subjected to the cutting pressure, so that the bearing points for swivelling the bits are subject to correspondingly high wear.

The invention now aims at providing a simple and operationally safe device of the initially mentioned type with which it is possible to swivel—without any risk of injury to the machine—the swivelling arm or cutting arm at higher speed if the cutting head hits softer rock or brittler rock. For solving this task, the initially mentioned device is essentially characterized in that the cutting arm carries a vibration sensor, the signals of which are coupled via an electronic control with the pivotal drive of the cutting arm, in particular controllable valves of a hydraulic pivotal drive. In view of the cutting arm carrying a vibration sensor, any inadmissible operating condition, i.e. too high a swivelling speed, arising on ingress of the cutting head into the rock for which a definite swivelling speed is intended can be recognized on the basis of the vibrations of the cutting arm, and the pivotal drive can be slowed down to the nominal swivelling speed for which the cutting head is designed prior to overloading parts of partial-cut cutting machine.

For the swivelling drive means of the cutting arms of partial-cut cutting machines, there are used, as a rule, hydraulic drive means. To achieve a swivelling speed increase over the nominal swivelling speed, the pivotal drive is preferably equipped with a hydraulic pump of variable supply capacity, preferably an axial piston pump. Such a hydraulic pump can be adjusted to a more rapid stroke for achieving a greater flow capacity.

The electronic control for slowing down the pivotal drive to the nominal swivelling speed for which the cutting head is designed may comprise, in an advantageous manner, a threshold switch. In this case, the threshold switch is preferably connected with an actuator for varying the supply capacity of the hydraulic pump of the pivotal drive. By means of such a threshold switch, the degree of the admissible vibration can be prescribed, and reduction of the swivelling speed down to nominal speed is effected only if inadmissible vibrations of the cutting machine actually occur.

According to a preferred further development of the invention, the arrangement is such that the threshold switch cooperates with a solenoid valve actuable by the electronic control, said solenoid valve connecting a control oil circuit comprising an independent source, in particular a pump, of pressurized control oil with a hydraulic drive for adjusting the supply capacity of the hydraulic pump of the pivotal drive. Such an arrangement, in which the control oil circuit for actuating the adjustment of the hydraulic drive of the traversing gear is independent of the hydraulic system for driving the traversing gear, has the advantage of higher operational safety, because such an arrangement provides the possibility of maintaining, even in case of a failure of the protecting device, at least normal operation of the cutting machine.

As soon as the machine has been subjected to inadmissible vibrations, it appears advantageous that a subsequent more rapid swivelling movement of the cutting arm can only intentionally, but not automatically, be initiated. For this purpose, the electronic control preferably has a locking relay and a manually operated key, noting that the relay is released on opening the threshold switch and that the relay can again be brought into locking position by actuating the manually operated key if the threshold switch is closed, and further noting that with the relay being released, the solenoid valve is deenergized. After a response of the electronic control, the locking relay must thus again be brought into ready position by means of the manually actuated key, which again is only possible if the threshold switch has also been closed again. Operational safety, in particular in case of a failure of the electronic control or of the current supply for the electronic control, can be improved if the solenoid valve connects, in its energized condition, the hydraulic drive for adjusting the supply capacity of the hydraulic pump of the pivotal drive in the sense of a maximum supply capacity thereof with the source of pressured control oil, and if the solenoid valve depressurizes, in its reset position, the hydraulic drive for adjusting the supply capacity of the hydraulic pump, noting that the supply capacity of the hydraulic pump is reduced to a predetermined operating value. In this case, the hydraulic drive for adjusting the supply capacity of the hydraulic pump of the pivotal drive can be loaded by a spring in the sense of reducing the flow capacity of the hydraulic pump of the pivotal drive. In this manner, it is made sure that in case of a failure of the electronic control, the nominal swivelling speed for which the geometry of the arrangement of the bits on the cutting head is calculated is automatically sought again in a self-acting manner.

A plurality of constructional parts is suitable as vibration sensors, of which are particularly mentioned inertia sensors or acceleration detectors.

In the following, the invention is further explained with reference to an embodiment shown in the drawing. In the drawing, FIG. 1 shows a side elevation of a cutting machine comprising a device according to the invention, FIG. 2 shows a circuitry for the device according to the invention, and FIG. 3 shows a detail of a hydraulic control for the pivotal drive of the cutting arm of a cutting machine according to FIG. 1.

In FIG. 1, the cutting machine is designated by 1. This cutting machine 1 has a cutting arm 2 which can be swivelled in height direction in the sense of the twin arrow 3 and around a substantially vertical swivelling axis 4 in the sense of the twin arrow 5, and which carries cutting heads 6 at its free end. A vibration sensor 7 is arranged on the cutting arm, the signals of which are supplied to an electronic control indicated by 8. A manually actuated key 10 is schematically indicated in the operator's cabin 9 and enables an increase of the swivelling speed of the cutting arm in the sense of the twin arrow 5. Further, a solenoid valve 11 which is actuated by the electronic control 8 is schematically indicated.

Figure 2:
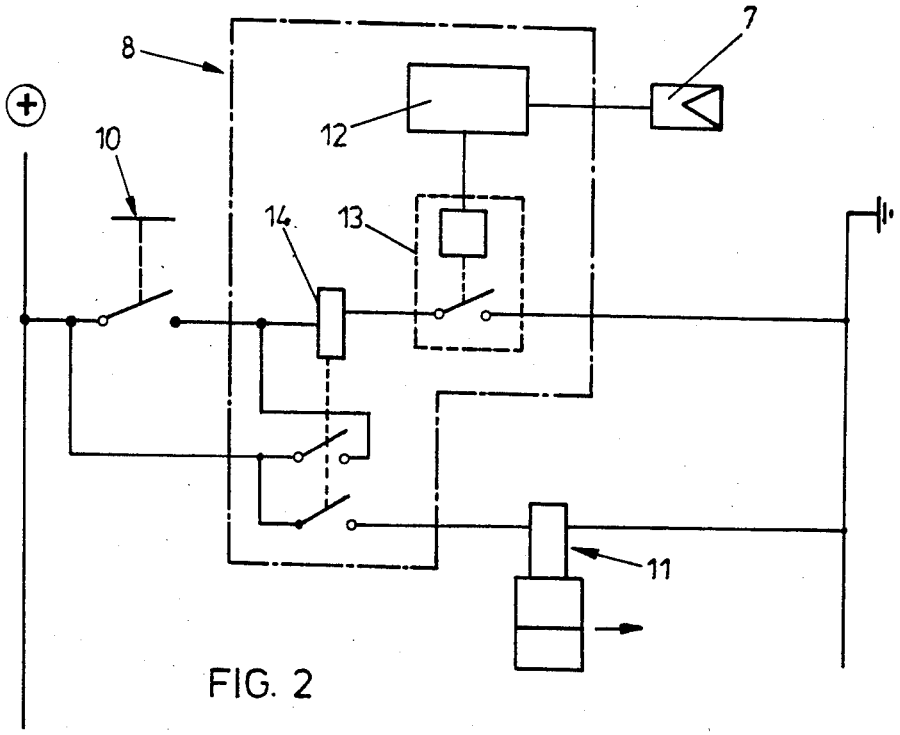
Figure 3:
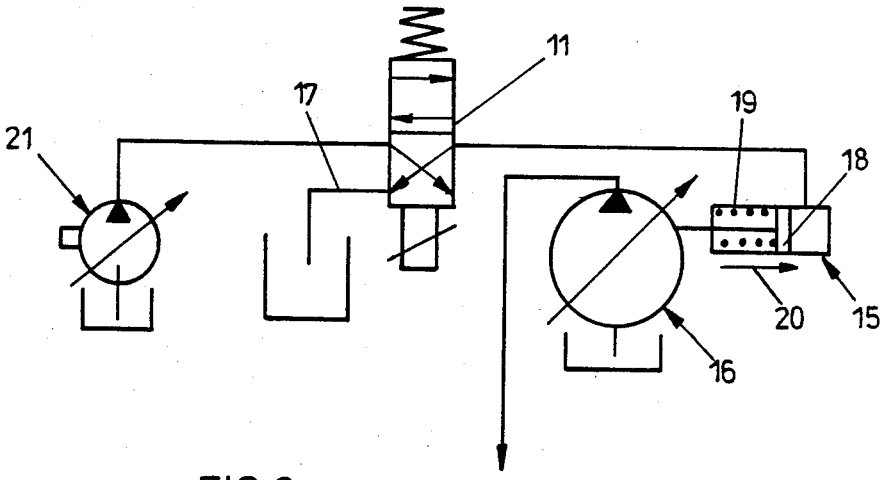

In FIG. 2, details of the electronic control are explained in detail. The acceleration detector or, respectively, vibration sensor is again designated by 7. The electronic control 8 comprises a data amplifier 12 as well as a threshold switch 13. The manually actuated key 10 is connected with a locking relay 14. This locking relay 14 as well as the threshold switch 13 are again connected via electric conduits with the solenoid valve 11.

On actuation of the manually actuated key 10 and with the current force switched on, the locking relay 14 assumes its locking position if the threshold switch 13 is closed. In this self-locking position, the solenoid valve 11 is—with the threshold switch 13 being closed—energized and thus in that position in which an accelerated swivelling movement is possible. As soon as the vibration sensor indicates inadmissible vibrations and as soon as the threshold switch 13 gives—with interposition of the data amplifier 12—a response, the locking relay 14 is released and the solenoid valve 11 assumes its rest position shown in FIG. 3. Further actuation of the protective circuit by actuating the manually actuated key 10 is only possible if simultaneously the threshold switch 13 is also again closed, noting that the closed position of the threshold switch 13 represents the rest position.

In FIG. 3, the solenoid valve 11 and the control oil circuit for adjusting the supply capacity of the hydraulic pump of the pivotal drive is further explained. The solenoid valve 11 is shown in its rest position, in which the winding is not energized by electric current. In this position, an adjusting drive for a hydraulic pump 16 of adjustable supply capacity and formed of a hydraulic cylinder-piston aggregate 15 is connected with a return conduit 17, so that the control piston 18 of the hydraulic cylinder-piston aggregate 15 is displaced in the direction of the arrow 20 by the force of a spring 19. In this starting position, the supply capacity of the hydraulic pump 16 is adjusted to the minimum supply capacity and thus to a low swivelling speed. As soon as the protective circuit is activated and the solenoid valve 11 is energized, the working space of the piston 18 of the hydraulic cylinder-piston aggregate 15 is connected with a control oil pump 21. By means of this control oil pump 21, the piston 18 is displaced in the left-hand direction in a sense opposing the direction of the arrow 2 and against the force of the spring 19, so that the hydraulic pump 16 of adjustable supply capacity is adjusted in the direction of its maximum supply capacity. Thus, a high swivelling speed of the cutting arm is allowed as long as the solenoid valve 11 is maintained in its energized condition.

What is claimed is:

1. A device for protecting a partial-cut cutting machine from overload, said machine comprising a pivotable cutting arm carrying a rotatably supported cutting head and a hydraulic drive including a hydraulic pump of variable capacity for pivoting said arm, said device comprising a vibration sensor carried by said arm for detecting vibration of said arm, said vibration sensor producing signals of which are coupled via an electronic control system with the pivotal drive of the cutting arm.

2. A device as in claim 1 wherein said hydraulic pump is an axial piston pump.

3. A device for protecting a partial-cut cutting machine from overload, said machine comprising a pivotable cutting arm carrying a rotatably supported cutting head and a hydraulic drive include a first hydraulic pump for pivoting said arm, said device comprising a vibration sensor carried by said arm for producing signals in response to vibration of said arm and said device further comprising a control system for controlling said hydraulic drive, said control system including a control oil circuit which includes a second hydraulic pump, hydraulic means for adjusting the supply capacity of said first pump and a solenoid valve controlling the flow of oil from said second pump to said hydraulic means, said control system further including a threshold switch operated in response to the signals produced by said sensor for operating said solenoid valve.

4. A device as in claim 3 wherein said control system includes a locking relay and a manually operable key, the relay being releasable from a locking position on opening of the threshold switch and being returnable to the locking position by the key if the threshold switch is closed, the solenoid valve being de-energized by release of the relay.

5. A device as in claim 3 wherein the solenoid valve, in its energized condition, connects the hydraulic means for adjusting the supply capacity of the first hydraulic pump in the sense of the maximum supply capacity of this pump with the source of pressurized control oil and, in its rest position, depressurizes the hydraulic means for adjusting the supply capacity of the first hydraulic pump, the supply capacity of the first hydraulic pump being reduced to a predetermined operating value.

6. A device for protecting a partial-cut cutting machine from overload, said machine comprising a pivotable cutting arm carrying a rotatably supported cutting head and a drive including a hydraulic pump for pivoting said arm, said device comprising a vibration sensor carried by said cutting arm, said vibration sensor producing signals which are coupled via an electronic control system with the pivotal drive of the cutting arm, said control system including a threshold switch connected with an actuator for varying the supply capacity of said pump.

7. A device as in claim 6 wherein the hydraulic drive for adjusting the supply capacity of the hydraulic pump of said drive is loaded by a spring which acts to reduce the flow capacity of the hydraulic pump.

8. A device for protecting a partial-cut cutting machine from overload, said machine comprising a pivotable cutting arm carrying a rotatably supported cutting head and a drive for pivoting said arm, said device comprising an inertia sensor carried by said cutting arm, said sensor producing signals which are via an electronic control system with the pivotal drive of the cutting arm.

9. A device for protecting a partial-cut cutting machine from overload, said machine comprising a pivotable cutting arm carrying a rotatably supported cutting head and a drive for pivoting said arm, said divice comprising an acceleration sensor carried by said cutting arm, said sensor producing signals which are coupled via an electronic control system with the pivotal drive of the cutting arm.

* * * * *